US006904155B2

(12) United States Patent
Yonehara et al.

(10) Patent No.: US 6,904,155 B2
(45) Date of Patent: Jun. 7, 2005

(54) ELECTRET CAPACITOR MICROPHONE

(75) Inventors: Kentaro Yonehara, Shizouka (JP); Motoaki Ito, Shizuoka (JP); Yoshio Imahori, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 131 days.

(21) Appl. No.: 10/357,374

(22) Filed: Feb. 4, 2003

(65) Prior Publication Data

US 2003/0161491 A1 Aug. 28, 2003

(30) Foreign Application Priority Data

Feb. 27, 2002 (JP) ..... P. 2002-050725

(51) Int. Cl.[7] ..... H04R 25/00

(52) U.S. Cl. ..... 381/174; 381/191; 381/369; 381/409

(58) Field of Search ..... 381/113, 116, 381/174, 190–191, 396, 398, 409–410, 173, 369; 367/140, 170, 181; 29/25.41

(56) References Cited

U.S. PATENT DOCUMENTS 5,272,758 A * 12/1993 Isogami et al. ..... 381/191

6,594,369 B1 * 7/2003 Une ..... 381/174

FOREIGN PATENT DOCUMENTS

JP 08-237797 A 9/1996

* cited by examiner

*Primary Examiner*—Huyen D. Le
(74) *Attorney, Agent, or Firm*—Sughrue Mion, PLLC

(57) ABSTRACT

An electret capacitor microphone includes an electret capacitor section having a diaphragm and a backplate, an impedance conversion element for converting a change in the electrostatic capacity of the electret capacitor section into an electric impedance, and a case for accommodating the electret capacitor section and the impedance conversion element. Part of the case is a synthetic resin-made base member formed integrally with a plurality of terminal members by insert molding. One end of the terminal member is exposed on an inner surface of the base member so as to form part of a conductive pattern. The other end of the terminal member is exposed on an outer surface of the base member as an external connection terminal portion. The impedance conversion element is mounted on the base member at a predetermined position in the conductive pattern.

9 Claims, 7 Drawing Sheets

54
54a
54b
54A
54B
54C
14
32
34a
32a
40a
C
52
52A
52B
24
24a
24b
24c
56A
56Aa
56B
56Ba
56C
56Ca
56D
56Da
58
P
III
III 52
52A
52B
P
56Aa
52a

P
56Aa
52b
58

56Ba
P
56Aa
20
18
52c
16
22
58
56Ca
56Da

ELECTRET CAPACITOR MICROPHONE

BACKGROUND OF THE INVENTION

1. Field of the Invention

This present invention relates to an electret capacitor microphone, particularly to a construction for permitting its surface mounting.

2. Background Art

Generally, an electret capacitor microphone is constructed such that a cylindrical metal case accommodates an electret capacitor section in which a diaphragm and a backplate are disposed to oppose each other, an impedance conversion element for converting a change in the electrostatic capacity of the electret capacitor section into an electric impedance, and a substrate on which this impedance conversion element is mounted.

This electret capacitor microphone is provided with a plurality of terminal members projecting from the substrate in the form of pins which are electrically conductive with the impedance conversion element. It is therefore structurally difficult to surface mount the electret capacitor microphone on an external substrate (e.g., a printed circuit board of a portable telephone or the like).

Accordingly, as described in JP-A-8-237797 for example, a measure is devised for surface mounting the electret capacitor microphone on an external substrate. In this measure, the electret capacitor microphone is fitted to a holder having contact pieces for surface mounting and is surface mounted on the external substrate via the holder.

However, with the above-described conventional electret capacitor microphone, it is necessary to interpose the holder at the time of surface mounting it on the external substrate. Accordingly, there occur problems such that an extra part becomes required and that the overall thickness becomes fairly large when the surface mounting is performed.

SUMMARY OF THE INVENTION

The present invention has been conceived in view of the above-described circumstances, and has its objective to provide an electret capacitor microphone which can be surface mounted on an external substrate, while being made thin with a small number of component parts.

The invention attains the above objective by forming the conventional substrate and terminal members in anew arrangement.

The invention provides an electret capacitor microphone, which includes: an electret capacitor section comprising a diaphragm and a backplate positioned opposite the diaphragm; an impedance conversion element for converting a change in the electrostatic capacity of the electret capacitor section into an electric impedance; and a case for accommodating the electret capacitor section and the impedance conversion element. Part of the case comprises a synthetic resin-made base member formed integrally with a plurality of terminal members by insert molding. One end of the terminal member is exposed on an inner surface of the base member so as to form part of a conductive pattern. The other end of the terminal member is exposed on an outer surface of the base member as an external connection terminal portion. The impedance conversion element is mounted on the base member at a predetermined position in the conductive pattern.

The invention also provides an electret capacitor microphone, which includes: an electret capacitor section comprising a diaphragm and a backplate positioned opposite the diaphragm; an impedance conversion element for converting a change in the electrostatic capacity of the electret capacitor section into an electric impedance; and a case for accommodating the electret capacitor section and the impedance conversion element. Part of the case comprises a synthetic resin-made base member formed integrally with a plurality of terminal members by MID molding. One end of the terminal member is exposed on an inner surface of the base member so as to form part of a conductive pattern. The other end of the terminal member is exposed on an outer surface of the base member as an external connection terminal portion. The impedance conversion element is mounted on the base member at a predetermined position in the conductive pattern.

The above-described "electret capacitor microphone" may be a foil electret-type electret capacitor microphone in which the diaphragm is provided with the function of an electret, or may be a back electret-type electret capacitor microphone in which a backplate is provided with the function of an electret.

This "electret capacitor microphone" may be constructed such that only the impedance conversion element is accommodated in the case as an electronic component, or may be constructed such that another electronic component such as a capacitor may be accommodated in addition to the impedance conversion element.

The aforementioned "impedance conversion element" is not limited to a specific element insofar as it is capable of converting a change in the electrostatic capacity of the capacitor section into an electric impedance. For example, it is possible to adopt a field effect transistor (FET) or the like.

As for portions other than the aforementioned "base member" in the aforementioned "case," their materials, shapes, and other specific arrangements are not particularly limited.

As for the aforementioned "conductive pattern," its specific shape of the pattern is not particularly limited insofar as it is capable of being formed on the inner surface of the base member.

As for the aforementioned "external connection terminal portion," its specific shapes, layout, and the like are not particularly limited insofar as they are exposed on the outer surfaces of the base member.

The aforementioned "MID molding" means a molding process for manufacturing molded interconnection devices (MID's). The "MID" referred to herein means a three-dimensional molded circuit device in which a three-dimensional circuit or pattern is formed on a resin molded device having a three-dimensional configuration.

According to the invention as described above, part of the case, which accommodates the electret capacitor section and the impedance conversion element, is a synthetic resin-made base member formed integrally with a plurality of terminal members by insert molding or MID molding. The terminal member has one end exposed on the inner surface of the base member so as to form part of the conductive pattern, while the other end is exposed on the outer surface of the base member as an external connection terminal portion. Further, the impedance conversion element is mounted on the base member at a predetermined position in the conductive pattern. Accordingly, while the base member is provided with the function of the conventional substrate, the shape and layout of the external connection terminal portion can be easily set arbitrarily. Thus, a suitable shape and layout of the external connection terminal portion would enable the electret capacitor microphone to be directly surface mounted on the external substrate without use of the conventional holder.

Therefore, according to the invention, it becomes possible to surface mount the electret capacitor microphone on the external substrate with a small number of component parts while making the electret capacitor microphone compact.

Moreover, with the conventional electret capacitor microphone, the case is generally made of metal and is electrically conductive with a grounding terminal. Then, it is necessary to space the case apart from the external substrate. In contrast, with the electret capacitor microphone according to the invention, since the base member is made of synthetic resin, it is unnecessary to space the base member apart from the external substrate. For this reason, the outer surface of the base member can be formed flush with the respective external connection terminal portions. Therefore, it becomes possible to further reduce the thickness when the electret capacitor microphone is surface mounted on the external substrate.

According to the invention, it is possible to provide post processing such as the cutting out of part of the conductive pattern after insert molding, with the result that the degree of freedom can be enhanced for the layout of the conductive pattern.

It should be noted that the electret capacitor microphone according to the invention is not necessarily surface mounted on the external substrate. It may be inserted into and mounted on the external substrate by forming the external connection terminal portions in the shape of pins, for example.

According to the invention, a through hole may be formed in a predetermined position of the base member, and the conductive pattern may be divided at the position where the through hole is formed. Then, it becomes possible to make part of the conductive pattern as an electrical island which is electrically separated from the other part of the conductive pattern, while maintaining their positional relationship.

On the other hand, according to the electret capacitor microphone in the invention, the plurality of terminal members may be formed integrally with the base member by MID molding, and the conductive pattern is formed by surface treatment such as plating or printing. Therefore, part of the conductive pattern can be formed in the shape of an island at the time of MID molding.

According to the invention, the electret capacitor section may be covered with a cylindrical metal cover. Then, it is possible to handle these members as one unit, thereby making the process of manufacturing the electret capacitor microphone simple.

If the case is comprised of the base member and a synthetic resin-made housing member fixed to the base member, the metal cover is covered by the housing member. In this case, even if heat is applied from outside, it is possible to make the heat difficult to be transmitted to the metal cover by virtue of the heat buffering function of the housing member made of synthetic resin. Hence, it is possible to suppress the temperature rise of the electret capacitor section. Accordingly, even in the case where the surface mounting on the external substrate is effected by reflow processing, it is possible to effectively suppress loss or decrease of the charge accumulated in the electret of the electret capacitor section due to the heat applied.

As for the metal cover which covers the electret capacitor section, the external shape is likely to be a substantially circular cylindrical shape. It is, however, preferable to set the external shape substantially in the shape of a rectangular parallelepiped, so that the electret capacitor microphone can be positioned easily at the time of surface mounting. At this time, if recessed spaces communicating with the internal space of the base member are formed in the respective corner portions of the housing member, it is possible to enlarge the back pressure space of the electret capacitor section by these recessed spaces, thereby making it possible to improve the sensitivity of the electret capacitor microphone. Furthermore, these recessed spaces can be utilized as thickness reducing spaces to prevent a surface sink on the housing member.

DETAILED DESCRIPTION OF THE PREFERRED EMBODIMENTS

Figure 1:
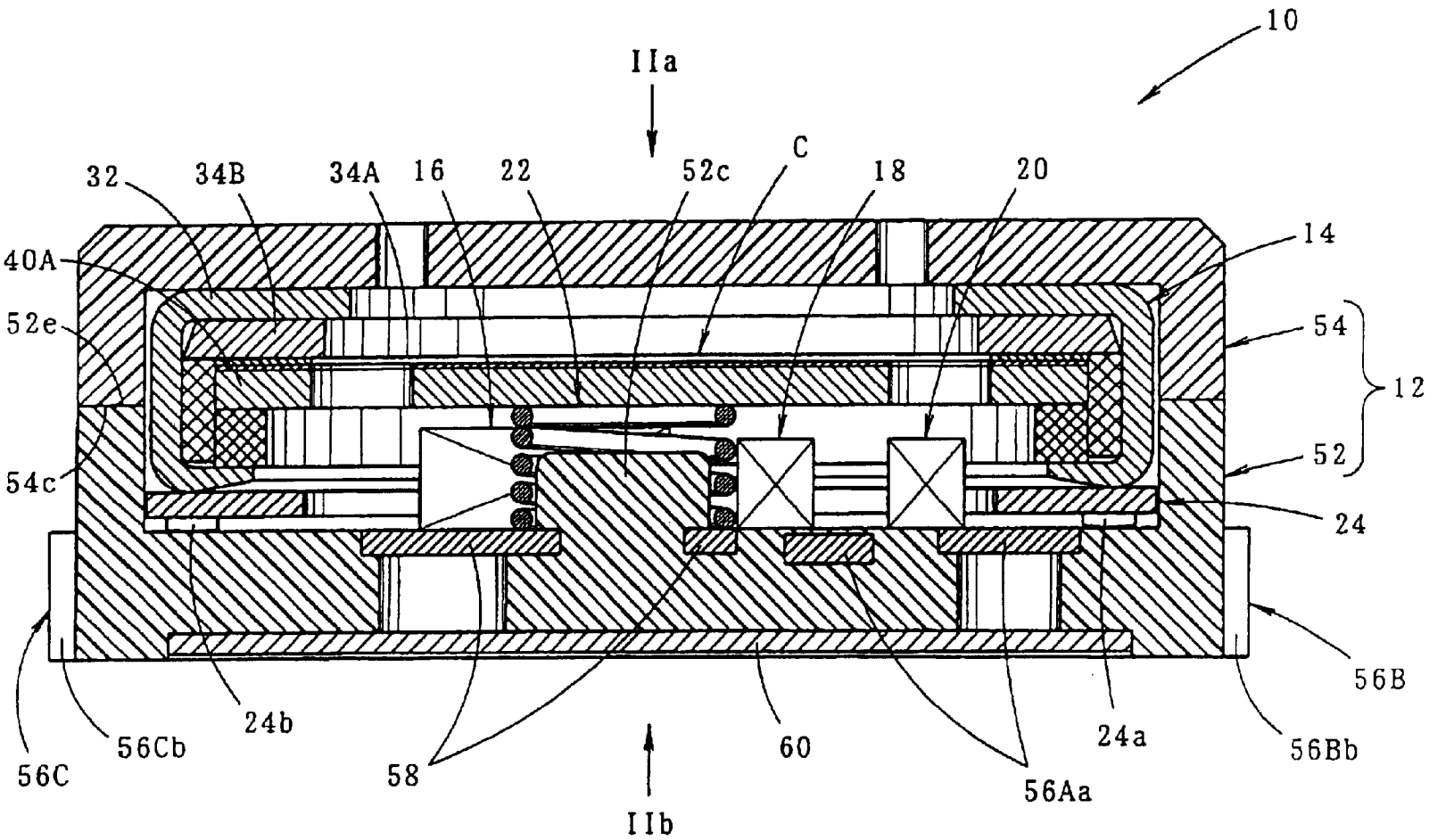
FIG. 1 is a side sectional view illustrating a state in which an electret capacitor microphone in accordance with an embodiment of the invention of this application is disposed upwardly.

Referring now to the drawings, a description will be given of an embodiment of the present invention.

Figure 2B:
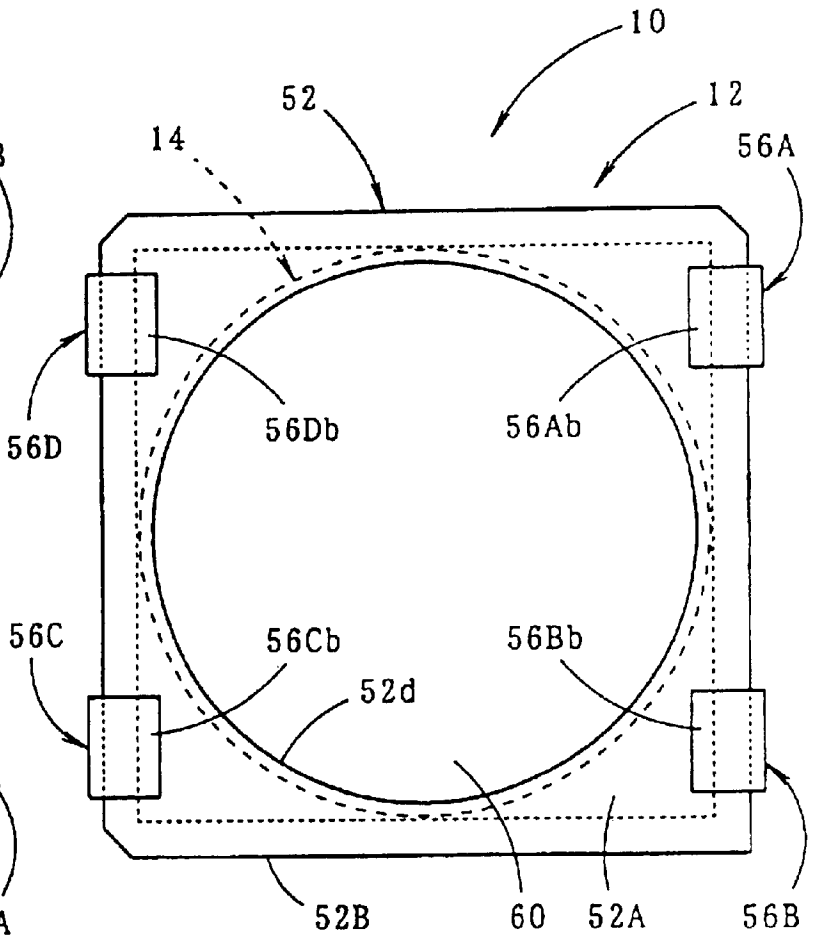
FIG. 2B is a view taken in the direction of arrow IIb in FIG. 1.
Figure 2A:
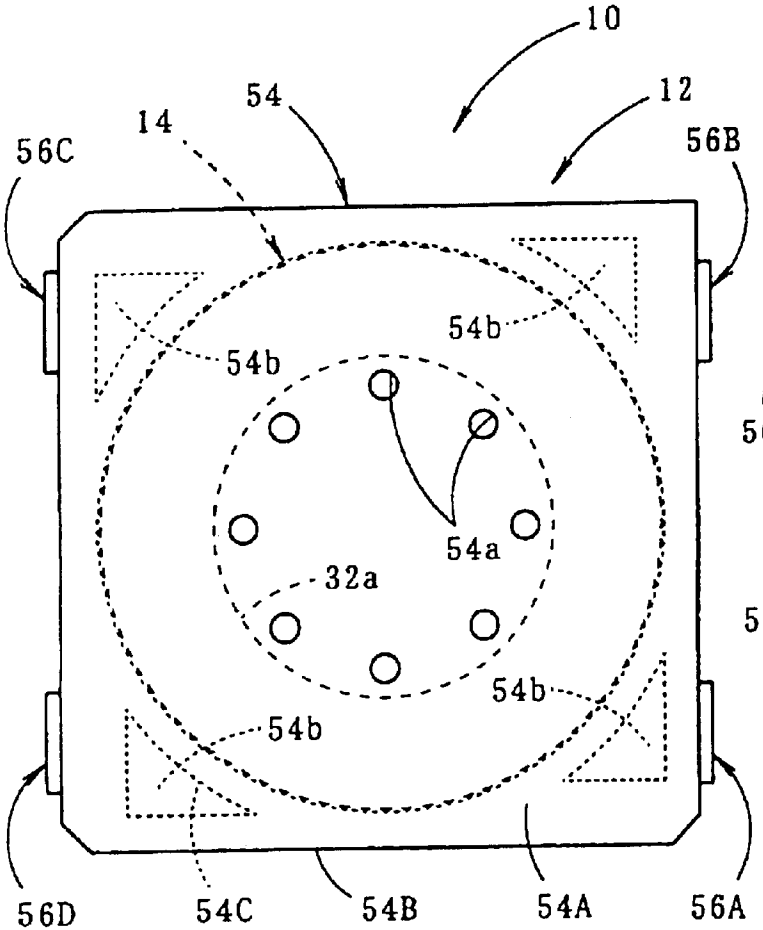
FIG. 2A is a view taken in the direction of arrow IIa in FIG. 1.
Figure 3:
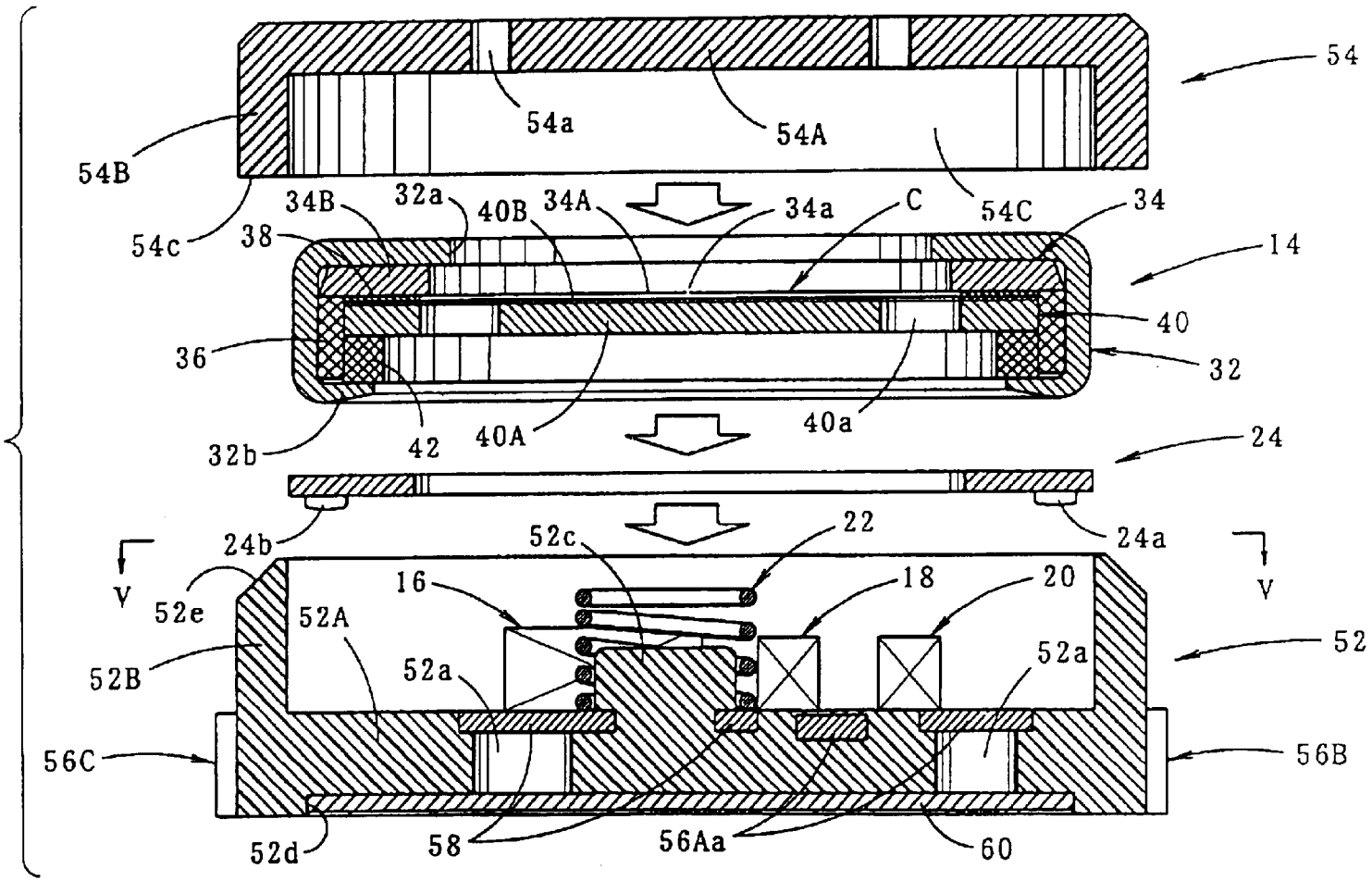
FIG. 3 is an exploded side sectional view of the electret capacitor microphone.
Figures 4A, 4B, 4C:
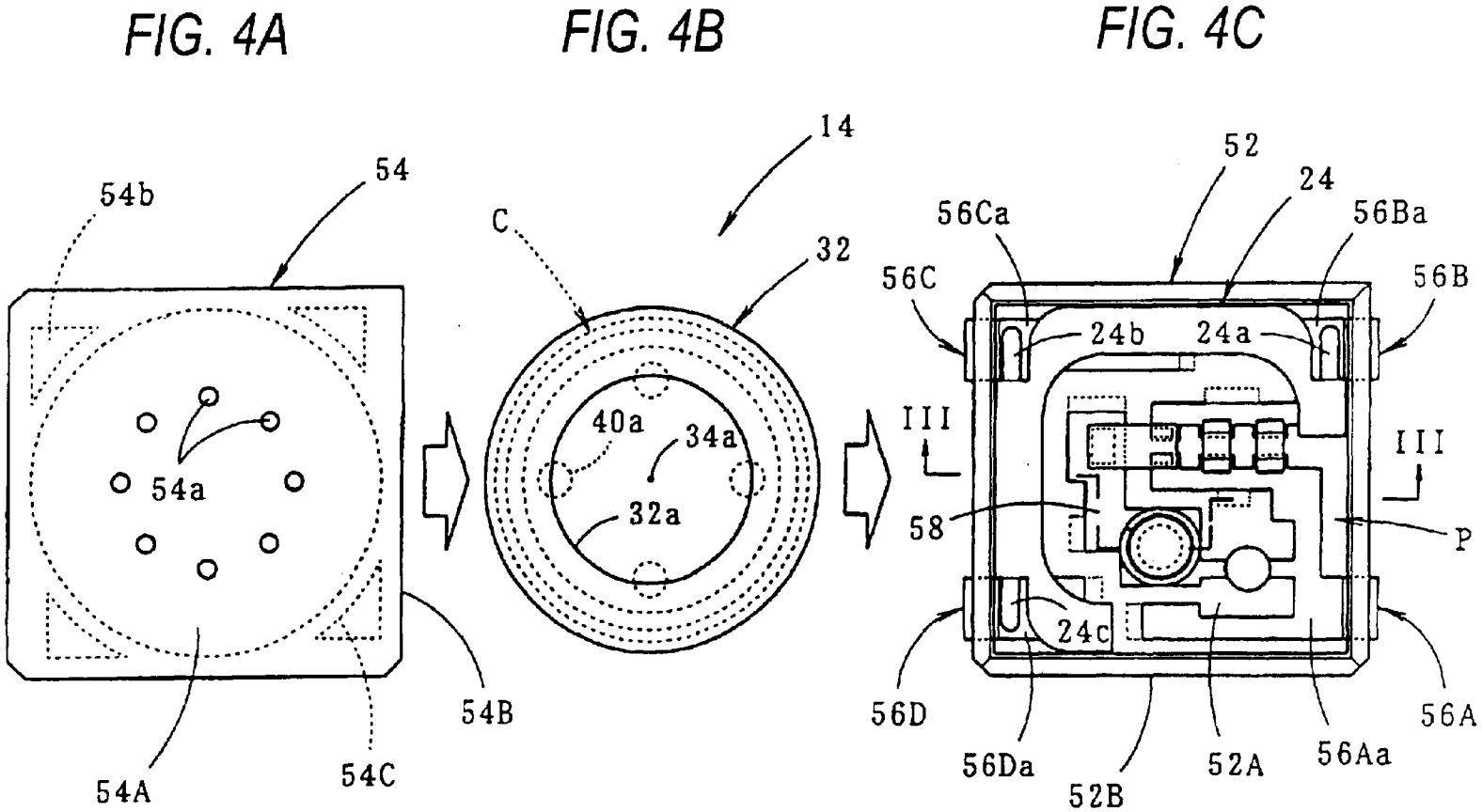
FIGS. 4A to 4C is an exploded plan view of the electret capacitor microphone.

FIG. 1 is a side sectional view illustrating a state in which an electret capacitor microphone in accordance with the embodiment is disposed upwardly. In addition, FIG. 2A is a view taken in the direction of arrow IIa in FIG. 1, and FIG. 2B is a view taken in the direction of arrow IIb in FIG. 1. Further, FIGS. 3 and 4 are an exploded side sectional view and an exploded plan view of the electret capacitor microphone.

As shown in these drawings, an electret capacitor microphone 10 in accordance with this embodiment is a compact microphone which has a substantially square outer configuration whose one side is 4.5 mm or thereabouts in a plan view and which is about 1.8 mm high. Accommodated within a case 12 are an electret capacitor unit 14, an FET 16 (impedance conversion element), two capacitors 18 and 20, a coil spring 22, and a contact frame 24.

As for the electret capacitor unit 14, a diaphragm subassembly 34, an insulating ring 36, a spacer 38, a backplate 40, and an insulating bush 42 are accommodated in a cylindrical metal cover 32 extending vertically and having a low height.

The metal cover 32 has a sound hole 32*a* formed in an upper end wall thereof. Its open lower end portion 32*b* is fixed to the insulating bush 42 by caulking.

The diaphragm subassembly 34 has a diaphragm 34A stretched underneath and fixed to a lower surface of a diaphragm supporting ring 34B. The diaphragm 34A is so arranged that a metal vapor-deposited film of nickel or the like is formed on an upper surface of a circular film made of synthetic resin (e.g., polyphenylene sulfide (PPS)), and is electrically conductive with the diaphragm supporting ring 34B. A vent hole 34*a* is formed in a central portion thereof. The diaphragm supporting ring 34B is formed of a metallic ring member having an outside diameter substantially equal to the inside diameter of the metal cover 32.

The insulating ring 36 is a ring member having an outside diameter substantially equal to the inside diameter of the metal cover 32, and insulation treatment (alumite coating) is provided on an aluminum surface.

The spacer 38 is formed of a thin sheet ring made of synthetic resin (e.g., PPS) and having an outside diameter substantially equal to the inside diameter of the insulating ring 36.

The backplate 40 is comprised of a stainless steel-made backplate body 40A and an electret 40B made of synthetic resin (e.g., fluorinated ethylene propylene (FEP)) thermally welded (laminated) on an upper surface of this backplate body 40A, and a plurality of through holes 40*a* are formed therein. The electret 40B is provided with polarization treatment to allow a predetermined surface potential (e.g., −125 V or thereabouts) to be obtained.

Inside the metal cover 32, the diaphragm 34A and the electret 40B are opposed to each other with a predetermined very small interval with the spacer 38 disposed therebetween, thereby forming a capacitor section C.

The insulating bush 42 is a synthetic resin molding (e.g., a liquid crystal polymer (LCP) molding), and is formed by a ring member having an outside diameter substantially equal to the inside diameter of the insulating ring 36.

As for the case 12, a base member 52 which is upwardly open and is made of synthetic resin (e.g., LCP) and a housing member 54 which is downwardly open and is made of synthetic resin (e.g., LCP) are fixed to each other by ultrasonic welding (which will be described later).

Figure 5:
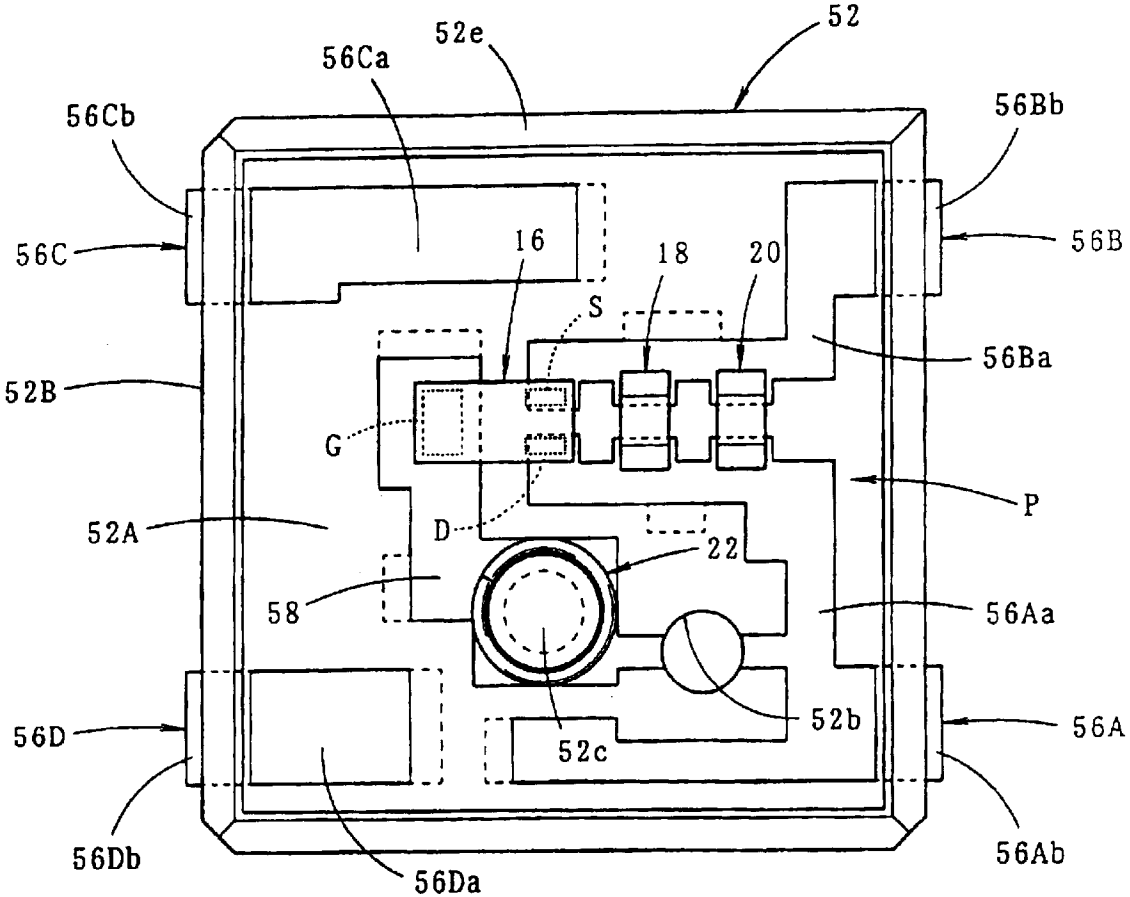
FIG. 5 is a sectional view taken along line V—V of FIG. 3, and illustrates a base member in detail.

FIG. 5 is a sectional view taken along line V—V of FIG. 3, and illustrates the base member 52 in detail. FIG. 6 is a process diagram illustrating the process of manufacturing and assembling the base member 52 and its accessories. In FIG. 3 (and in FIG. 1), the base member 52 is shown by a section taken along line III—III of FIG. 4C.

As shown in these drawings as well, the base member 52 is comprised of a substantially square bottom wall portion 52A and a peripheral wall portion 52B extending upward from an outer peripheral edge of this bottom wall portion 52A, and is formed integrally with four terminal members 56A, 56B, 56C, and 56D by insert molding. These four terminal members 56A, 56B, 56C, and 56D are formed as inserts by subjecting a strip-shaped conductive member to blanking and bending.

One end portions of these terminal members 56A, 56B, 56C, and 56D are exposed on an inner surface (upper surface) of the bottom wall portion 52A as four land portions 56Aa, 56Ba, 56Ca, and 56Da which constitute portions of an electrically conductive pattern P. Meanwhile, the other end portions of the terminal members 56A, 56B, 56C, and 56D are exposed on an outer surface of the bottom wall portion 52A as four external connection terminal portions 56Ab, 56Bb, 56Cb, and 56Db. These external connection terminal portions 56Ab, 56Bb, 56Cb, and 56Db are formed in L-shapes in such a manner as to extend along the lower surface of the bottom wall portion 52A and to be bent and extend along the outer surface of the peripheral wall portion 52B in the vicinities of the respective corners of the bottom wall portion 52A. At that time, with respect to the bottom wall portion 52A, the external connection terminal portions 56Ab, 56Bb, 56Cb, and 56Db are formed flush with the lower surface of the bottom wall portion 52A by insert molding, while, with respect to the peripheral wall portion 52B, they are formed in such a manner as to project by their thickness from the outer surface of the peripheral wall portion 52B by cutting and bending after insert molding.

Of the four terminal members 56A, 56B, 56C, and 56D, the terminal member 56A is an output terminal which is connected to a power supply through a load resistor when it is mounted on an external substrate. The terminal member 56B is a grounding terminal, and the remaining two terminal members 56C and 56D are dummy terminals.

Figures 6A, 6B, 6C:
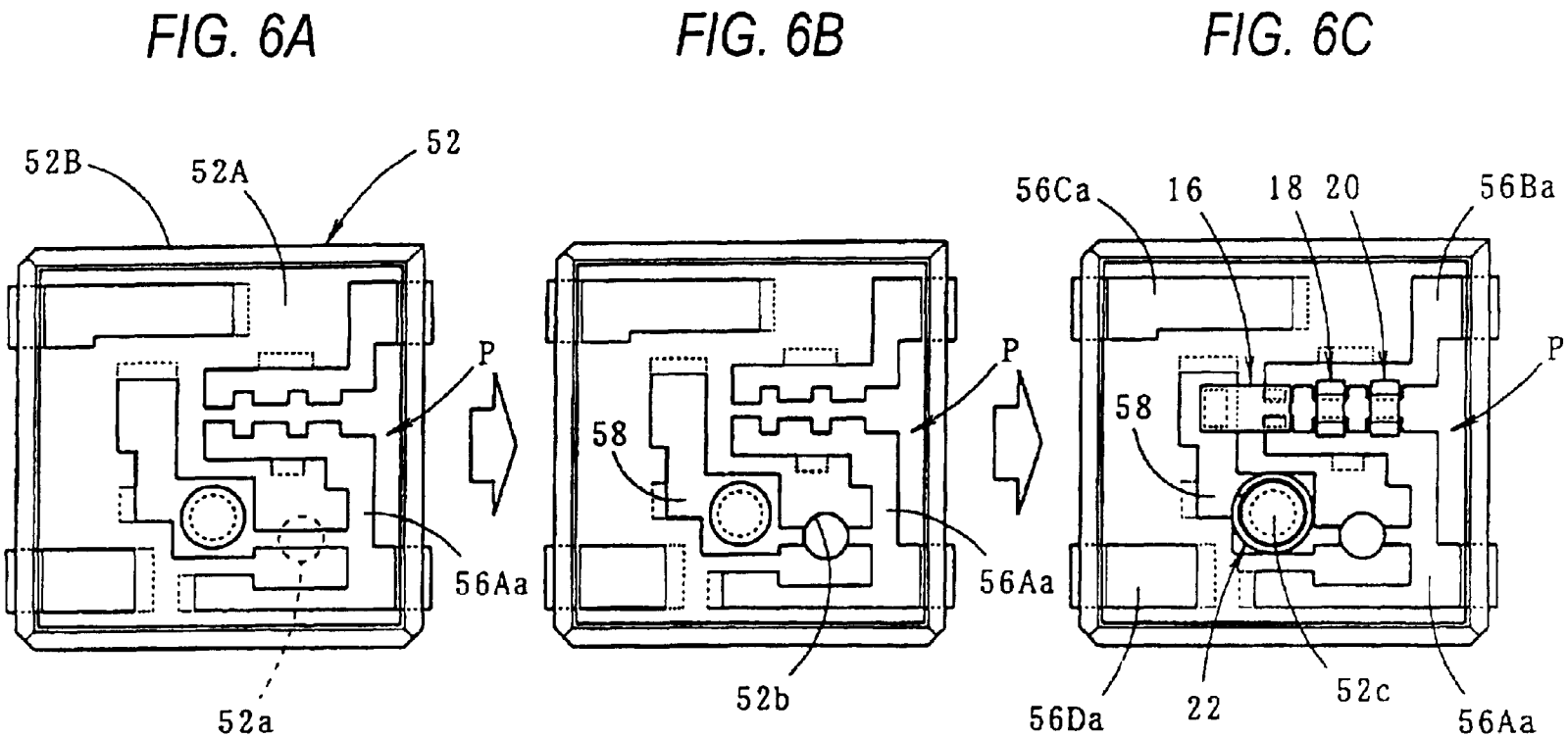
FIGS. 6A to 6C is a process diagram illustrating the process of manufacturing and assembling the base member and its accessories.

A plurality of cavity portions 52*a* are formed in the bottom wall portion 52A of the base member 52 by insert support pins at the time of insert molding, and one of these cavity portions 52*a* is formed on the lower side of the electrically conductive pattern P, as shown in FIG. 6A. Further, as a pin is inserted in this cavity portion 52*a* after insert molding in such a manner as to pierce the electrically conductive pattern P from above (or by such as the application of a laser beam), thereby forming a through hole 52*b* to divide the electrically conductive pattern P, as shown in FIG. 6B. In consequence, another land portion 58 which is electrically separated from the land portion 56Aa is formed on the inner surface of the bottom wall portion 52A of the base member 52.

The FET 16 and the capacitors 18 and 20 are mounted on the base member 52 at predetermined positions of the electrically conductive pattern P.

The FET 16 is an element for converting a change in the electrostatic capacity of the electret capacitor section C into an electric impedance, and is mounted such that its drain electrode D conducts with the land portion 56Aa of the terminal member 56A, its source electrode S conducts with the land portion 56Ba of the terminal member 56B, and its gate electrode G conducts with the land portion 58. In addition, the capacitors 18 and 20 are two kinds of capacitors having different electrostatic capacities and provided to eliminate noise, and are mounted in parallel in such a manner as to straddle the land portion 56Aa of the terminal member 56A and the land portion 56Ba of the terminal member 56B.

A spring loading boss 52*c* projecting upward at the position where the land portion 58 is formed is formed on the inner surface of the bottom wall portion 52A of the base member 52. The coil spring 22 is loaded on this spring loading boss 52*c*. This coil spring 22 is made of metal. When the electret capacitor microphone 10 is assembled, the coil spring 22 is compressively and resiliently deformed in a state in which each end portion thereof abuts against the land portion 58 or the backplate body 40A. As a result, the gate electrode G of the FET 16 is made conductive with the backplate body 40A through the land portion 58 and the coil spring 22.

The contact frame 24 is formed by blanking a stainless steel sheet substantially into an L-shape and bending a portion thereof, and three terminal contact pieces 24*a*, 24*b*, and 24*c* projecting diagonally downward are formed at three portions thereof. This contact frame 24 has an external shape which is substantially identical to the shape of inner surface of the peripheral wall portion 52B of the base member 52. When the contact frame 24 is fitted inside the base member 52, its terminal contact pieces 24*a*, 24*b*, and 24*c* are brought into contact with the land portions 56Ba, 56Ca, and 56Da of the terminal members 56B, 56C, and 56D.

Further, this contact frame 24 is arranged such that when the electret capacitor microphone 10 is assembled, this contact frame 24, its terminal contact pieces 24*a*, 24*b*, and 24*c* are slightly flexurally deformed by coming into contact with the metal cover 32 of the electret capacitor unit 14. As a result, the source electrode S of the FET 16 is made conductive with the diaphragm 34A through the land portion 56Ba of the terminal member 56B, the contact frame 24, the metal cover 32, and the diaphragm supporting ring 34B, and is also made conductive with the land portions 56Ca and 56Da of the terminal members 56C and 56D, thereby making it possible for these terminal members 56C and 56D to be used as the grounding terminals.

A shallow circular recess 52*d* having an inside diameter substantially equal to the outside diameter of the electret capacitor unit 14 is formed in the outer surface (lower surface) of the bottom wall portion 52A of the base member 52. A metallic shield plate 60 which is thinner than the depth of that circular recess 52*d* is bonded and fixed to the circular recess 52*d*.

The housing member 54 has a top wall portion 54A whose shape is identical to that of the bottom wall portion 52A of the base member 52, a peripheral wall portion 54B extending downward from an outer peripheral edge of this top wall portion 54A, and an annular wall portion 54C extending downward from the top wall portion 54A in such a manner as to surround the electret capacitor unit 14. A plurality of sound releasing holes 54*a* are formed in this housing member 54. Recessed spaces 54*b* communicating with the internal space of the base member 52 are formed in the respective corner portions of this housing member 54 by the peripheral wall portion 54B and the annular wall portion 54C.

The ultrasonic welding of the base member 52 and the housing member 54 is performed in the following manner.

As shown in FIG. 3, the peripheral wall portion 52B of the base member 52 has an upper end face 52*e* having the substantially pyramidical shape over the entire periphery. Meanwhile, the peripheral wall portion 54B of the housing member 54 has a lower end face 54*c* formed flat over the entire periphery. As ultrasonic vibrations are imparted to the upper end face 52*e* of the peripheral wall portion 52B and the lower end face 54*c* of the peripheral wall portion 54B in a state that they are brought into surface contact with each other over their entire peripheries. Whereby, portions of the peripheral wall portion 52B located in the vicinities of their upper end face are primarily deformed plastically. Consequently, as shown in FIG. 1, the upper end face 52*e* of the peripheral wall portion 52B and the lower end face 54*c* of the peripheral wall portion 54B are welded and fixed over their entire peripheries.

As described above in detail, as for the electret capacitor microphone 10 in accordance with this embodiment, part of the case 12, which accommodates the electret capacitor section C, the FET 16, and the capacitors 18 and 20, comprises the synthetic resin-made base member 52 formed integrally with the plurality of terminal members 56A, 56B, 56C, and 56D by insert molding. As for the terminal members 56A, 56B, 56C, and 56D, their one end portions are exposed on the inner surface of the bottom wall portion 52A of the base member 52 as the land portions 56Aa, 56Ba, 56Ca, and 56Da which form part of the electrically conductive pattern P, while their other end portions are exposed on the outer surface of the bottom wall portion 52A of the base member 52 as the external connection terminal portions 56Ab, 56Bb, 56Cb, and 56Db. Further, the FET 16 and the capacitors 18 and 20 are mounted on the base member 52 at predetermined positions on the electrically conductive pattern P. Accordingly, it is readily possible to set the shapes and layout of the external connection terminal portions 56Ab, 56Bb, 56Cb, and 56Db arbitrarily, while providing the base member 52 with the function of the conventional substrate.

Further, since the external connection terminal portions 56Ab, 56Bb, 56Cb, and 56Db in this embodiment are formed in the shape of plates in the respective corner portions of the base member 52, they are suitable for surface mounting on the external substrate. Specifically, the surface mounting on the external substrate can be effected stably. Consequently, it becomes possible to directly surface mount the electret capacitor microphone 10 on the external substrate without the interposition of the holder in the conventional manner.

Therefore, in accordance with this embodiment, it becomes possible to surface mount the electret capacitor microphone 10 on the external substrate with a small number of component parts while making the electret capacitor microphone 10 compact.

Particularly in this embodiment, by virtue of the presence of the contact frame 24, not only the terminal member 56B but the terminal members 56C and 56D can be used as grounding terminals, so that the surface mounting on the external substrate can be performed more easily.

Since the electret capacitor microphone 10 in this embodiment is provided with the base member 52 made of synthetic resin, it is unnecessary to space the base member 52 apart from the external substrate. Further, the external connection terminal portions 56Ab, 56Bb, 56Cb, and 56Db are formed flush with the lower surface of the bottom wall portion 52A at the corner portions of the base member 52. Therefore, it becomes possible to further reduce the thickness when the electret capacitor microphone 10 is surface mounted on the external substrate.

In addition, in this embodiment, since the through hole 52*b* is formed in a predetermined position of the bottom wall portion 52A of the base member 52, and the electrically conductive pattern P is divided at the position where the through hole 52*b* is formed, part of the electrically conductive pattern P formed integrally at the time of insert molding can be electrically separated and formed in the shape of an island while its positional relationship with the other part of the electrically conductive pattern P is maintained. Namely, in this embodiment, the land portion 58 which is made conductive with the gate electrode G of the FET 16 can be formed in the shape of an island on the inner surface of the bottom wall portion 52A of the base member 52 while its positional relationship with the land portion 56Aa of the terminal member 56A, which is made conductive with the drain electrode D of the FET 16, is maintained.

Further, in this embodiment, the electret capacitor section C is covered with the cylindrical metal cover 32, and is formed as the electret capacitor unit 14, thereby making the process of manufacturing the electret capacitor microphone 10 simple.

Moreover, the case 12 is comprised of the base member 52 and the synthetic resin-made housing member 54 fixed thereto. It is possible to make the heat difficult to be transmitted to the metal cover 32, even in a case where heat is applied from outside, due to the heat buffering characteristic of the housing member 54 covering the metal cover 32. Hence, it is possible to suppress the temperature rise of the electret capacitor section C. Accordingly, even in a case where the surface mounting on the external substrate is effected by reflow processing, it is possible to effectively suppress loss or decrease of the charge accumulated in the electret 40B of the electret capacitor section C due to the heat applied thereto at the time of reflow processing.

In this embodiment, since the fixation of the base member 52 and the housing member 54 is effected by ultrasonic welding over their entire peripheries, it is possible to enhance the sealing capabilities of the two members. In addition, since this makes it unnecessary to use an adhesive agent, it eliminates the possibility of generation of gas from the adhesive agent at the time of reflow processing. It therefore eliminates the possibility of loss or decrease of the charge stored in the electret 40B of the electret capacitor section C due to accumulated gas in the case 12.

Further, the upper end face 52*e* of the peripheral wall portion 52B of the base member 52 is formed in the shape of substantially pyramidical surface, it is possible to concentrate the energy of ultrasonic vibration on the contact surface of the peripheral wall portion 52B and the peripheral wall portion 54B of the housing member 54, thereby making it possible to easily effect the ultrasonic welding with respect to the housing member 54. Moreover, since this ultrasonic welding is effected in a state in which the upper end face 52*e* of the peripheral wall portion 52B and the lower end face 54*c* of the peripheral wall portion 54B are brought into surface contact with each other over their entire peripheries, it becomes possible to impart transverse ultrasonic vibrations in the direction parallel to the contact surface. Further, by adopting the transverse vibration, it is possible to suppress the effect of the vibration on the component parts (FET 16 and capacitors 18 and 20) mounted on the base member 52.

It should be noted that the upper end face 52*e* having the shape of substantially pyramidical surface may be intermittently formed at a plurality of portions of the peripheral wall portion 52B at predetermined intervals. In such a case as well, the base member 52 and the housing member 54 can be finally fixed by ultrasonic welding over their entire peripheries, so that it is possible to sufficiently ensure the sealing capabilities of the two members.

In addition, instead of forming the upper end face 52*e* of the peripheral wall portion 52B in the base member 52 in the shape of substantially pyramidical surface, the lower end face 54*c* of the peripheral wall portion 54B in the housing member 54 may be formed in the shape of substantially pyramidical surface. In such a case as well, it is possible to obtain operational advantages similar to those of this embodiment.

In this embodiment, since the external shape of the case 12 is set substantially in the shape of a rectangular parallelepiped, the electret capacitor microphone 10 can be positioned easily when it is mounted on the external substrate. Moreover, since the recessed spaces 54*b* communicating with the internal space of the base member 52 are formed in the respective corner portions of the housing member 54, it is possible to enlarge the back pressure space of the electret capacitor section C by these recessed spaces 54*b*, thereby making it possible to improve the sensitivity of the electret capacitor microphone 10. In addition, the recessed spaces 54*b* can be utilized as thickness reducing spaces to prevent a surface sink on the housing member.

Next, a description will be given of a modification of the above-described embodiment.

Figure 7:
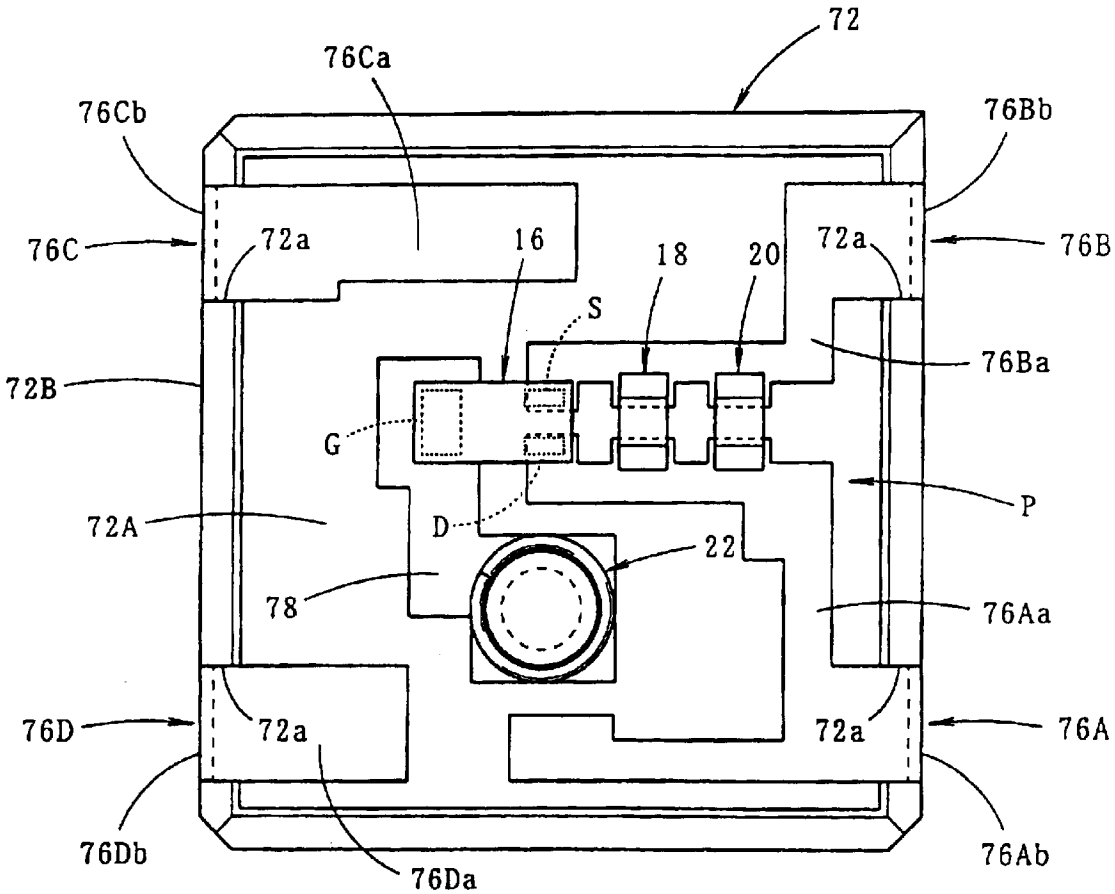
FIG. 7 is a diagram similar to FIG. 5 and illustrates a modification of the embodiment.

FIG. 7 is a diagram similar to FIG. 5 and illustrates the modification.

As shown in the drawing, in this modification, four terminal members 76A, 76B, 76C, and 76D are formed integrally with a base member 72 by molded interconnection device (MID) molding. It should be noted that the other component elements of the electret capacitor microphone are constructed in the same way as in the above-described embodiment.

In the same way as the base member 52 of the above-described embodiment, the base member 72 is comprised of a substantially square bottom wall portion 72A and peripheral wall portion 72B extending upward from outer peripheral edge of this bottom wall portion 72A. The terminal members 76A, 76B, 76C, and 76D are surface treated films of copper plating or the like.

One end portions of the terminal members 76A, 76B, 76C, and 76D are exposed on an inner surface (upper surface) of the bottom wall portion 72A of the base member 72 as four land portions 76Aa, 76Ba, 76Ca, and 76Da which form portions of the electrically conductive pattern P. The other end portions thereof are exposed on an outer surface of the base member 72 as four external connection terminal portions 76Ab, 76Bb, 76Cb, and 76Db. These external connection terminal portions 76Ab, 76Bb, 76Cb, and 76Db are formed flush with the peripheral wall portion 72B and the bottom wall portion 72A in such a manner as to extend along the outer surfaces of the peripheral wall portion 72B and to be bent and extend along the lower surface of the bottom wall portion 72A.

To realize the construction of such terminal members 76A, 76B, 76C, and 76D, notched portions 72*a* which are notched substantially flush with the inner surface of the bottom wall portion 72A are formed at four portions of the peripheral wall portions 72B of the base member 72.

In this modification, a land portion 78, which is electrically separated from the land portions 76Aa, 76Ba, 76Ca, and 76Da, is also formed simultaneously on the inner surface of the base member 72A of the base member 72 at the time of the aforementioned MID molding.

Also in the case where the construction of this modification is adopted, it is possible to obtain operational advantages similar to those of the above-described embodiment. Moreover, in this modification, part of the electrically conductive pattern P can be formed in the shape of an island at the time of MID molding.

In addition, in this modification, since the external connection terminal portions 76Ab, 76Bb, 76Cb, and 76Db of the terminal members 76A, 76B, 76C, and 76D are formed flush with the peripheral wall portion 72B and the bottom wall portion 72A, the electret capacitor microphone can be constructed compactly, and it is possible to reduce the occupied space when it is surface mounted on an external substrate.

In this modification, although the ultrasonic welding of the base member 72 and the housing member cannot be effected over the entire peripheries, it is possible to ensure the sealing capabilities of the two members if a filler material is subsequently filled in the respective notched portions 72*a*.

Incidentally, instead of forming the terminal members 76A, 76B, 76C, and 76D in such a manner as to extend along the outer surfaces of the peripheral wall portion 72B and to be bent and extend along the lower surface of the bottom wall portion 72A as in this modification, an arrangement may be provided such that four through holes are formed in advance in the bottom wall portion 72A of the base member 72, and the other end portions of the terminal members 76A, 76B, 76C, and 76D are made to be exposed from the lower surface of the base member 72 through these through holes.

What is claimed is:

1. An electret capacitor microphone, comprising:

an electret capacitor section comprising a diaphragm and a backplate positioned opposite the diaphragm;

an impedance conversion element for converting a change in the electrostatic capacity of the electret capacitor section into an electric impedance; and a case made of synthetic resin and accommodating the electret capacitor section and the impedance conversion element;

wherein:

the case comprises a synthetic resin-made base member and a synthetic resin-made housing member;

the base member is formed integrally with a plurality of terminal members by insert molding;

one end of the terminal member is exposed on an inner surface of the base member so as to form part of a conductive pattern;

the other end of the terminal member is exposed on an outer surface of the base member as an external connection terminal portion;

the impedance conversion element is mounted on the base member at a predetermined position in the conductive pattern;

the base member includes a peripheral wall portion extending upward from an outer peripheral edge of the base member; and the synthetic resin-made housing member is fixed to the peripheral wall portion of the base member so as to form an outer housing.

2. The electret capacitor microphone as claimed in claim 1, wherein a through hole is formed in a predetermined position of the base member; and the conductive pattern is divided at the position where the through hole is formed.

3. The electret capacitor microphone as claimed in claim 2, wherein the electret capacitor section is covered with a metal cover.

4. The electret capacitor microphone as claimed in claim 3, wherein the metal cover has a substantially circular cylindrical external shape;

the case has an external shape formed substantially in the shape of a rectangular parallelepiped; and a recessed space communicating with an internal space of the base member is formed in each of corner portions of the housing member.

5. The electret capacitor microphone as claimed in claim 1, wherein the electret capacitor section is covered with a metal cover.

6. The electret capacitor microphone as claimed in claim 5, wherein the metal cover has a substantially circular cylindrical external shape;

the case has an external shape formed substantially in the shape of a rectangular parallelepiped; and a recessed space communicating with an internal space of the base member is formed in each of corner portions of the housing member.

7. An electret capacitor microphone, comprising:

an electret capacitor section comprising a diaphragm and a backplate positioned opposite the diaphragm;

an impedance conversion element for converting a change in the electrostatic capacity of the electret capacitor section into an electric impedance; and a case formed of synthetic resin and accommodating the electret capacitor section and the impedance conversion element;

wherein:

the case comprises a synthetic resin-made base member and a synthetic resin-made housing member;

the base member is formed integrally with a plurality of terminal members by Molded Interconnect Device molding;

one end of the terminal member is exposed on an inner surface of the base member so as to form part of a conductive pattern;

the other end of the terminal member is exposed on an outer surface of the base member as an external connection terminal portion;

the impedance conversion element is mounted on the base member at a predetermined position in the electrically conductive pattern;

the base member includes a peripheral wall portion extending upward from an outer peripheral edge of the base member; and the synthetic resin-made housing member is fixed to the peripheral wall portion of the base member so as to form an outer housing.

8. The electret capacitor microphone as claimed in claim 7, wherein the electret capacitor section is covered with a metal cover.

9. The electret capacitor microphone as claimed in claim 8, wherein the metal cover has a substantially circular cylindrical external shape;

the case has an external shape formed substantially in the shape of a rectangular parallelepiped; and a recessed space communicating with an internal space of the base member is formed in each of corner portions of the housing member.

* * * * *